US011741906B2

(12) United States Patent
Kim et al.

(10) Patent No.: US 11,741,906 B2
(45) Date of Patent: Aug. 29, 2023

(54) DATA DRIVING CIRCUIT AND DISPLAY DEVICE

(71) Applicant: LG DISPLAY CO., LTD., Seoul (KR)

(72) Inventors: Changhee Kim, Paju-si (KR); Kimin Son, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/559,340

(22) Filed: Dec. 22, 2021

(65) Prior Publication Data

US 2022/0208116 A1 Jun. 30, 2022

(30) Foreign Application Priority Data

Dec. 24, 2020 (KR) ..... 10-2020-0183849
Oct. 12, 2021 (KR) ..... 10-2021-0135212

(51) Int. Cl.
*G09G 3/3275* (2016.01)

(52) U.S. Cl.
CPC ... *G09G 3/3275* (2013.01); *G09G 2300/0439* (2013.01); *G09G 2300/0842* (2013.01); *G09G 2310/08* (2013.01); *G09G 2320/0626* (2013.01)

(58) Field of Classification Search
None
See application file for complete search history.

(56) References Cited

U.S. PATENT DOCUMENTS

2016/0189623 A1* 6/2016 Miwa ..... G09G 3/3233 345/212
2018/0144717 A1* 5/2018 Kim ..... G09G 5/10

FOREIGN PATENT DOCUMENTS

EP 3040971 A1 7/2016
KR 10-2015-0017287 A 2/2015

OTHER PUBLICATIONS

Extended European Search Report issued by the European Patent Office dated May 2, 2022 in corresponding European Patent Application No. 21216943.7.

* cited by examiner

*Primary Examiner* — Nitin Patel
*Assistant Examiner* — Amen W Bogale
(74) *Attorney, Agent, or Firm* — Morgan, Lewis & Bockius LLP

(57) ABSTRACT

A data driving circuit and a display device are provided. A display device includes: a display panel including a plurality of subpixels, each of the plurality of subpixels including: a light-emitting device, and a driving transistor configured to drive the light-emitting device, and a data driving circuit configured to: supply a data voltage to the plurality of subpixels, and supply, in a display period, to at least one subpixel among the plurality of subpixels: the data voltage, obtained by adding a first voltage corresponding to a luminance of the light-emitting device, and a second voltage smaller than a change value of a threshold voltage of the driving transistor.

14 Claims, 11 Drawing Sheets

DATA DRIVING CIRCUIT AND DISPLAY DEVICE

CROSS-REFERENCE TO RELATED APPLICATIONS

This application claims the benefit of and priority to Korean Patent Application No. 10-2020-0183849, filed on Dec. 24, 2020, and Korean Patent Application No. 10-2021-0135212, filed on Oct. 12, 2021, the entirety of each of which is hereby incorporated by reference.

BACKGROUND

1. Technical Field

The present disclosure relates to a data driving circuit and a display device.

2. Discussion of the Related Art

The growth of the information society leads to increased demand for display devices to display images and use of various types of display devices, such as liquid crystal display devices, organic light-emitting display devices, etc. Among such display devices, the organic light-emitting display device utilizes an organic light-emitting diode that emits light by itself, so that there may be advantages in rapid response speed, excellent contrast ratio, and high color reproduction.

The organic light-emitting display device may include, for example, an organic light-emitting diode disposed in each subpixel, and a driving transistor for supplying a driving current to the organic light-emitting diode. As the driving time of the organic light-emitting display device increases, circuit elements, such as organic light-emitting diodes and driving transistors disposed in subpixels, may deteriorate. Further, a characteristic value of the driving transistor may change due to deterioration of the driving transistor.

As the characteristic values of the driving transistors change, deviations may occur in characteristic values between the driving transistors disposed in the subpixels, so that the driving current supplied to the organic light-emitting diode by the driving transistor may not be accurately controlled. Accordingly, there is a need for a method for preventing image quality abnormality of the organic light-emitting display device due to deterioration of the driving transistor.

SUMMARY

Accordingly, the present disclosure is directed to a data driving circuit and a display device that substantially obviate one or more of the issues due to limitations and disadvantages of the related art.

Embodiments of the present disclosure may be capable of compensating the change in characteristic value due to deterioration of a driving transistor supplying a driving current to a light-emitting device disposed in a subpixel by a circuit structure, and a driving method of the subpixel.

Embodiments of the present disclosure may be capable of improving an accuracy of compensation in compensating for changes in characteristic values due to deterioration of the driving transistor by the circuit structure, and a driving method of the subpixel.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, there is provided a display device, including: a display panel including a plurality of subpixels, and a data driving circuit configured to supply a data voltage to the plurality of subpixels, wherein each of the plurality of subpixels includes: a light-emitting device, a driving transistor configured to drive the light-emitting device, and a storage capacitor electrically connected between a first node and a second node of the driving transistor, wherein the data driving circuit is further configured to: detect, in an external sensing period, a change value of a threshold voltage of the driving transistor included in at least one of the plurality of subpixels, and supply, in a display period, to at least one subpixel of the plurality of subpixels: the data voltage, obtained by adding a first voltage corresponding to a luminance of the light-emitting device, and a second voltage smaller than the change value of the threshold voltage of the driving transistor.

In another aspect, there is provided a display device, including: a display panel including a plurality of subpixels, each of the plurality of subpixels including: a light-emitting device, and a driving transistor configured to drive the light-emitting device, and a data driving circuit configured to: supply a data voltage to the plurality of subpixels, and supply, in a display period, to at least one subpixel among the plurality of subpixels: the data voltage, obtained by adding a first voltage corresponding to a luminance of the light-emitting device, and a second voltage smaller than a change value of a threshold voltage of the driving transistor.

In another aspect, there is provided a data driving circuit, including: a sensing unit configured to detect a change value of a threshold voltage of a driving transistor, in at least one of a plurality of subpixels, in an external sensing period, and a data voltage output unit configured to supply, in a display period, to at least one subpixel of the plurality of subpixels: a data voltage obtained by adding a first voltage corresponding to a luminance of the subpixel, and a second voltage smaller than the change value of the threshold voltage of the driving transistor.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages may be discussed below in conjunction with embodiments of the disclosure. It is to be understood that both the foregoing general description and the following detailed description of the present disclosure may be examples and explanatory, and may be intended to provide further explanation of the disclosure as claimed.

BRIEF DESCRIPTION OF THE DRAWINGS

The accompanying drawings, that may be included to provide a further understanding of the disclosure and may be incorporated in and constitute a part of this disclosure, illustrate embodiments of the disclosure and together with the description serve to explain various principles of the disclosure.

Figure 1:
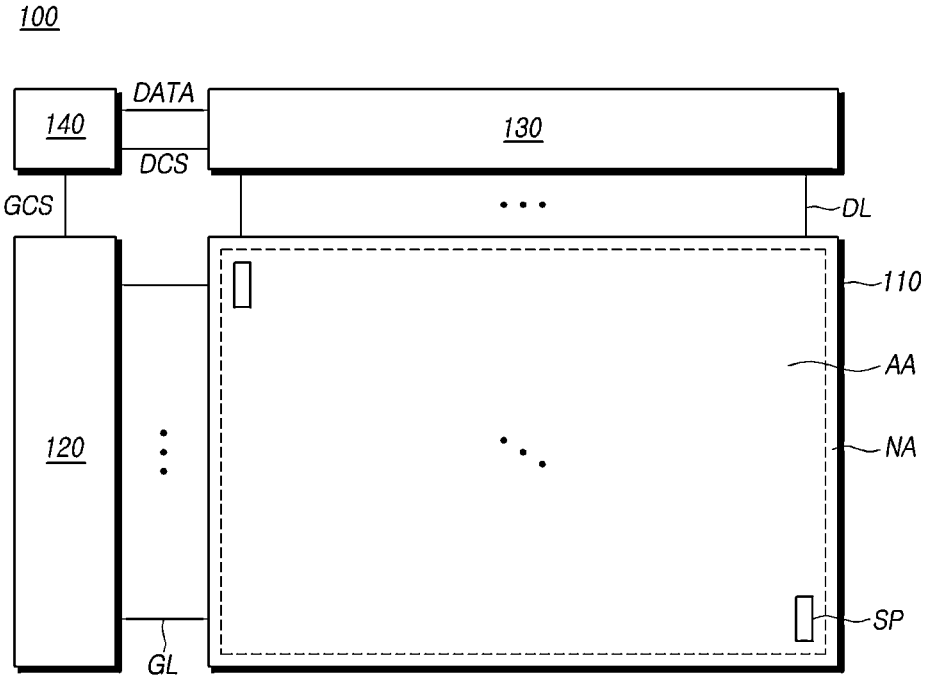
FIG. 1 schematically illustrates a configuration of a display device according to embodiments of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations may be selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments may be provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure may be merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. When terms "include," "have," and "include" described in the present disclosure may be used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, when a position relation between two parts is described as, for example, "on," "over," "under," or "next," one or more other parts may be disposed between the two parts unless a more limiting term, such as "just" or "direct(ly)," is used. In describing a time relationship, when the temporal order is described as, for example, "after," "subsequent," "next," or "before," a case that is not continuous may be included, unless a more limiting term, such as "just," "immediate(ly)," or "direct(ly)," is used.

It will be understood that, although the terms "first," "second," etc. May be used herein to describe various elements, these elements should not be limited by these terms. These terms may be only used to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms may be merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings may be given merely for the convenience of description, and embodiments of the present disclosure may not be limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning for example consistent with their meaning in the context of the relevant art and should not be interpreted in an idealized or overly formal sense unless expressly so defined herein. For example, the term "part" or "unit" may apply, for example, to a separate circuit or structure, an integrated circuit, a computational block of a circuit device, or any structure configured to perform a described function as should be understood to one of ordinary skill in the art.

Hereinafter, example embodiments of the present disclosure will be described in detail with reference to the accompanying drawings.

FIG. 1 schematically illustrates a configuration included in a display device according to embodiments of the present disclosure.

With reference to FIG. 1, a display device 100 may include a display panel 110, a gate driving circuit 120 and a data driving circuit 130 for driving the display panel 110, a controller 140, or the like. The display panel 110 may include an active area AA, in which a plurality of subpixels SP may be disposed, and a non-active area NA positioned outside the active area AA.

A plurality of gate lines GL and a plurality of data lines DL may be disposed on the display panel 110. The subpixel SP may be positioned in a region where the gate line GL and the data line DL intersect. The gate driving circuit 120 may be controlled by the controller 140. The gate driving circuit 120 can sequentially output scan signals to the plurality of gate lines GL arranged on the display panel 110, thereby controlling the driving timing of the plurality of subpixels SP.

The gate driving circuit 120 may include one or more gate driver integrated circuits (GDICs). The gate driving circuit 120 may be located only at one side of the display panel 110, or can be located at both sides thereof, according to a driving method.

Each gate driver integrated circuit (GDIC) may be connected to a bonding pad of the display panel 110 by a tape-automated bonding (TAB) method or a chip-on-glass (COG) method. Alternatively, each gate driver integrated circuit (GDIC) may be implemented as a gate-in-panel (GIP) type, and may be disposed directly on the display panel 110. Alternatively, each gate driver integrated circuit (GDIC) may be integrated, and may be disposed on the display panel 110 in some cases. Alternatively, each gate driver integrated circuit (GDIC) may be implemented in a chip-on-film (COF) method mounted on a film connected to the display panel 110. Embodiments are not limited to these examples.

The data driving circuit 130 may receive a data signal DATA from the controller 140, and may convert the data signal into an analog data voltage Vdata. The data driving circuit 130 may output the data voltage Vdata to each data line DL, according to the timing at which the scan signal may be applied through the gate line GL, so that each of the plurality of subpixels SP may emit light having brightness according to the data signal.

The data driving circuit 130 may include one or more source driver integrated circuits (SDICs). Each source driver integrated circuit (SDIC) may include a shift register, a latch circuit, a digital-to-analog converter, an output buffer, and the like.

Each source driver integrated circuit (SDIC) may be connected to a bonding pad of the display panel 110 by a tape-automated bonding (TAB) method or a chip-on-glass (COG) method. Alternatively, each source driver integrated circuit (SDIC) may be disposed directly on the display panel 110. Alternatively, each source driver integrated circuit (SDIC) may be integrated, and may be disposed on the display panel 110 in some cases. Alternatively, each source driver integrated circuit (SDIC) may be implemented in a chip-on-film (COF) manner. In this case, each source driver integrated circuit (SDIC) may be mounted on a film connected to the display panel 110, and may be electrically connected to the display panel 110 through lines on the film. Embodiments are not limited to these examples.

The controller 140 may supply various control signals to the gate driving circuit 120 and the data driving circuit 130, and may control the operation of the gate driving circuit 120 and the data driving circuit 130. The controller 140 may be mounted on a printed circuit board or a flexible printed circuit. The controller 140 may be electrically connected to the gate driving circuit 120 and the data driving circuit 130 through a printed circuit board or a flexible printed circuit.

The controller 140 may control the gate driving circuit 120 to output a scan signal according to timing implemented in each frame. The controller 140 may convert an externally received image data to match a signal format used by the data driving circuit 130, and may output the converted data signal to the data driving circuit 130. The controller 140 may receive various timing signals, including a vertical synchronization signal (VSYNC), a horizontal synchronization signal (HSYNC), an input data enable signal (DE), a clock signal (CLK) from the outside (e.g., a host system).

The controller 140 may generate various control signals by using various timing signals received from the outside, and may output the control signals to the gate driving circuit 120 and the data driving circuit 130. For example, to control the gate driving circuit 120, the controller 140 may output various gate control signals GCS, including a gate start pulse (GSP), a gate shift clock (GSC), and a gate output enable signal (GOE).

The gate start pulse (GSP) may control an operation start timing of one or more gate driver integrated circuits (GDICs) constituting the gate driving circuit 120. The gate shift clock (GSC), which may be a clock signal commonly input to one or more gate driver integrated circuits (GDICs), may control the shift timing of a scan signal. The gate output enable signal (GOE) may specify timing information on one or more gate driver integrated circuits (GDICs).

In addition, to control the data driving circuit 130, the controller 140 may output various data control signals DCS, including a source start pulse (SSP), a source sampling clock (SSC), a source output enable signal (SOE), or the like. The source start pulse (SSP) may control a data sampling start timing of one or more source driver integrated circuits (SDICs) constituting the data driving circuit 130. The source sampling clock (SSC) may be a clock signal for controlling the timing of sampling data in the respective source driver integrated circuits (SDICs). The source output enable signal (SOE) may control the output timing of the data driving circuit 130.

The display device 100 may further include a power management integrated circuit for supplying various voltages or currents to the display panel 110, the gate driving circuit 120, the data driving circuit 130, and the like. The power management integrated circuit may control various voltages or currents to be supplied thereto.

Each subpixel SP may be a region defined by an intersection of the gate line GL and the data line DL, in which at least one circuit element including a light-emitting device may be disposed. For example, when the display device 100 is an organic light-emitting display device, an organic light-emitting diode OLED and various circuit elements may be disposed in the plurality of subpixels SP. The display device 100 may control the current supplied to the organic light-emitting diode OLED disposed in the subpixel SP by driving several circuit elements, so that each subpixel SP may be controlled to display brightness corresponding to image data.

Figure 2:
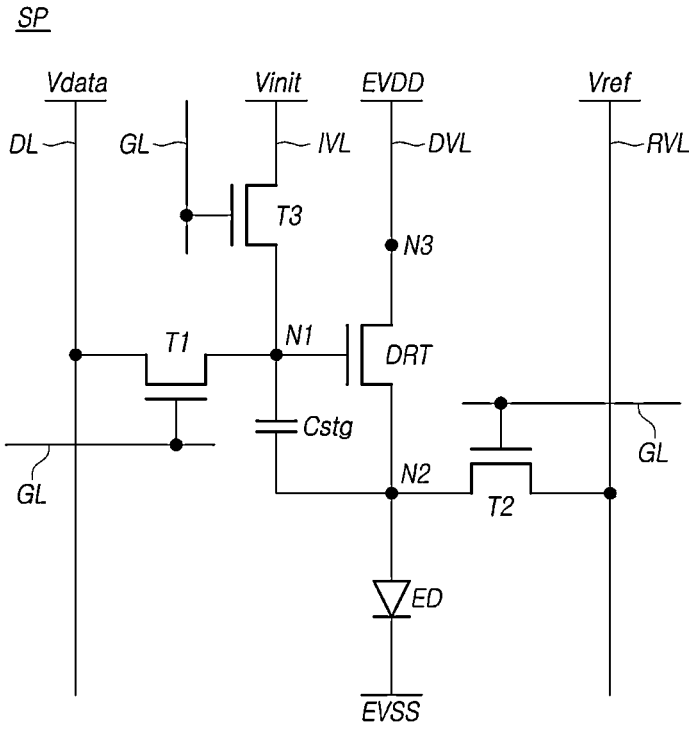
FIG. 2 illustrates an example of a circuit structure of a subpixel included in a display device according to embodiments of the present disclosure.

FIG. 2 illustrates an example of a circuit structure of the subpixel included in the display device according to embodiments of the present disclosure.

With reference to FIG. 2, each of the plurality of subpixels SP disposed on the display panel 110 may include a light-emitting device ED and a driving transistor DRT for driving the light-emitting device ED. The subpixel SP may further include one or more transistors in addition to the driving transistor DRT. Also, the subpixel SP may include one or more capacitors.

FIG. 2 illustrates an example in which three transistors T1, T2, and T3 are disposed in the subpixel SP, in addition to the driving transistor DRT, and one storage capacitor Cstg is disposed. FIG. 2 illustrates an example of a four-transistor, one capacitor (4T1C) structure, however, embodiments of the present disclosure are not limited thereto.

The driving transistor DRT may be electrically connected between a driving voltage line DVL and a light-emitting device ED. A first driving voltage EVDD may be supplied through the driving voltage line DVL, and the first driving voltage EVDD may be a high potential driving voltage.

The driving transistor DRT may control the driving current supplied to the light-emitting device ED. One electrode of the light-emitting device ED may be electrically connected to the driving transistor DRT. The other electrode of the light-emitting device ED may be electrically connected to a second driving voltage EVSS. The second driving voltage EVSS may be a low potential driving voltage. The light-emitting device ED may emit light according to the driving current supplied from the driving transistor DRT, and may express the luminance corresponding to image data.

The first transistor T1 may be electrically connected between the data line DL and a first node N1. The first node N1 may be a gate node of the driving transistor DRT.

The first transistor T1 may be controlled by a scan signal supplied through the gate line GL. The first transistor T1 may be controlled so that a data voltage Vdata, supplied through the data line DL, is applied to the first node N1, which may be the gate node of the driving transistor DRT.

The second transistor T2 may be electrically connected between the reference voltage line RVL and a second node N2. The second node N2 may be a source node or a drain node of the driving transistor DRT. A third node N3, to which the driving transistor DRT is electrically connected to the driving voltage line DVL, may be a drain node or a source node.

The second transistor T2 may be controlled by a scan signal supplied through the gate line GL. The second transistor T2 may be controlled so that a reference voltage Vref, supplied through the reference voltage line RVL, is applied to the second node N2.

The third transistor T3 may be electrically connected between an initialization voltage line IVL and the first node N1. The third transistor T3 may be controlled by a scan signal supplied through the gate line GL. The third transistor T3 may control the application of an initialization voltage Vinit to the first node N1, which may be the gate node of the driving transistor DRT.

The storage capacitor Cstg may be electrically connected between the first node N1 and the second node N2. The storage capacitor Cstg may maintain the data voltage Vdata for one frame period.

The driving transistor DRT or the light-emitting device ED, disposed in the subpixel SP, may be deteriorated as the driving time of the display device 100 increases. The deterioration of the driving transistor DRT may cause a change in a characteristic value, such as a threshold voltage or mobility of the driving transistor DRT.

The display device 100, according to embodiments of the present disclosure, may provide a method for compensating for deterioration of the driving transistor DRT disposed in the subpixel SP. As an example, the characteristic value of the driving transistor DRT disposed in the subpixel SP may be detected during a preset period.

The data voltage Vdata may be supplied by adding a compensation value calculated based on the detected characteristic value, so that it may be possible to compensate for a change in the characteristic value of the driving transistor DRT. This compensation method may be referred to as an "external" compensation method.

Alternatively, the compensation for the characteristic value of the driving transistor DRT may be performed during the driving process of the subpixel SP. When the data voltage Vdata is supplied after compensation is performed, the display driving may be performed without being affected by a change in the characteristic value of the driving transistor DRT. This compensation method may be referred to as an "internal" compensation method.

The circuit structure of the subpixel SP shown in the example of FIG. 2 is a structure in which both the above-described external compensation and internal compensation can be performed. The change in the characteristic value of the driving transistor DRT may be compensated for by the external compensation method or the internal compensation method, according to circumstances.

When the compensation for a change in the characteristic value of the driving transistor DRT is performed by the internal compensation, the change in the characteristic value of the driving transistor DRT may be compensated for simultaneously with driving the display without performing driving for detecting the characteristic value of the driving transistor DRT.

Figure 3:
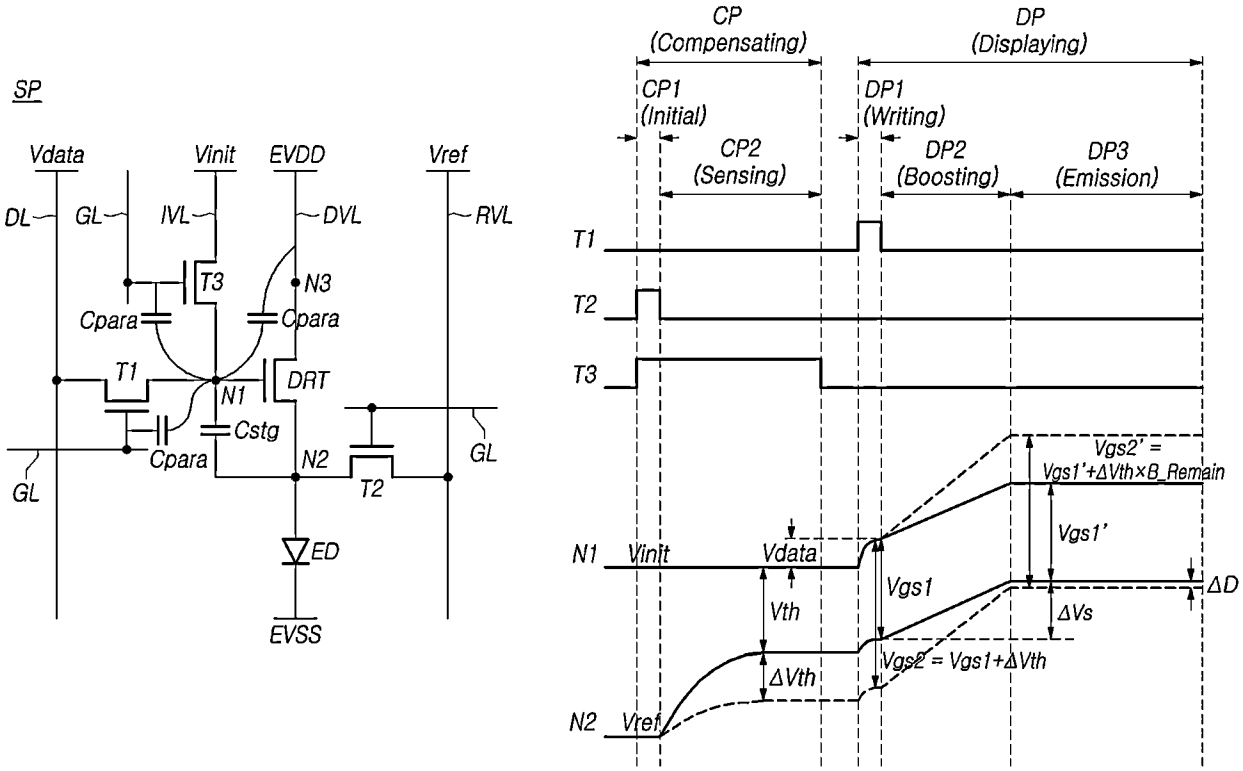
FIG. 3 illustrates an example of a driving method of a subpixel included in a display device according to embodiments of the present disclosure.

FIG. 3 illustrates an example of a driving method of a subpixel included in a display device according to embodiments of the present disclosure.

FIG. 3 illustrates an example of an internal compensation method for compensating for a change in the characteristic value of the driving transistor DRT disposed in the subpixel SP during the driving process of the subpixel SP. For example, one frame period for driving the subpixel SP may include a compensation period CP and a display period DP. The frame period is a time period. The frame period is also referred to the frame rate (expressed in frames per second or FPS) which is the frequency (rate) at which images (frames) are displayed on the display device 100. The frame period can be 1/(the frame rate). The frame period can include an active period and a blank period. The active period can be a time period that the data voltage Vdata is supplied to the subpixels SP. And the blank period can be a time period between the two adjacent active periods.

The compensation period CP may include a first compensation period CP1 corresponding to an initialization period and a second compensation period CP2 corresponding to a sensing period. For example, the sensing period may be a sensing period for internal compensation, and may be referred to as an "internal" sensing period. The display period DP may include a first display period DP1 corresponding to a data writing period, a second display period DP2 corresponding to a boosting period, and a third display period DP3 corresponding to a light emission period.

In the initialization period of the compensation period CP, the first transistor T1 may be in a turn-off state. In the initialization period of the compensation period CP, the second transistor T2 may be turned on, and the third transistor T3 may be turned on.

When the third transistor T3 is turned on, an initialization voltage Vinit may be applied to the first node N1. When the second transistor T2 is turned on, a reference voltage Vref may be applied to the second node N2. The difference between the initialization voltage Vinit and the reference voltage Vref may be, for example, greater than the threshold voltage Vth of the driving transistor DRT.

In the sensing period of the compensation period CP, the second transistor T2 may be turned off, and the third transistor T3 may maintain a turn-on state. When the second transistor T2 is turned off, the second node N2 may be in a floating state. When the second node N2 is in the floating state and the initialization voltage Vinit is applied to the first node N1, a voltage of the second node N2 forming a capacitance with the first node N1 may increase.

If a certain time elapses, the voltage of the second node N2 may be in a saturation state. In the saturation state, a difference between the voltage of the first node N1 and the voltage of the second node N2 may correspond to the threshold voltage Vth of the driving transistor DRT. In addition, if the driving transistor DRT is deteriorated, the difference between the voltage of the first node N1 and the voltage of the second node N2 in the saturation state may correspond to (Vth+ΔVth), which is the changed threshold voltage of the driving transistor DRT. By driving in the compensation period CP, a voltage difference corresponding to the changed threshold voltage of the driving transistor DRT may be formed between the first node N1 as the gate node of the driving transistor DRT and the second node N2 as the source node of the driving transistor DRT.

Accordingly, it may be possible to compensate for the change value ΔVth of the threshold voltage of the driving transistor DRT. In an embodiment, the change value of the threshold voltage of the driving transistor DRT included in a first subpixel among the plurality of subpixels SP may be zero (0), and the change value of the threshold voltage of the driving transistor DRT included in a second subpixel may not be zero. Further, in a light emission period of the display period, a voltage of the second node N2 of the driving transistor DRT, included in the first subpixel, may be the same as a voltage of the second node N2 of the driving transistor DRT included in the second subpixel.

In the display period DP after the compensation period CP, the first transistor T1 may be turned on during the data writing period. When the first transistor T1 is turned on, the data voltage Vdata supplied through the data line DL may be applied to the first node N1.

The data voltage Vdata may be a voltage corresponding to the luminance of the light-emitting device ED disposed in the subpixel SP. That is, the data voltage Vdata may be a voltage for expressing a grayscale according to image data.

The first transistor T1 may be turned off during a boosting period of the display period DP. When the second transistor T2 is also turned off during the boosting period of the display period DP, both the first node N1 and the second node N2 may be in a floating state.

When both the first node N1 and the second node N2 are in the floating state, the voltage of the first node N1 and the voltage of the second node N2 may increase. An amount that the voltage of the second node N2 increase may be ΔVs, and the amount may be configured based on the voltage applied to the first node N1 and the voltage applied to the second node N2.

If the voltage of the second node N2 increases to match an operating point of the light-emitting device ED, a driving current, corresponding to the difference between the voltage of the gate node of the driving transistor DRT and the voltage of the source node of the driving transistor DRT, may be supplied to the light-emitting device ED. During the light emission period of the display period DP, the voltage of the first node N1 and the voltage of the second node N2 may be constantly maintained, and the light-emitting device ED may display a luminance corresponding to the data voltage Vdata.

As described above, according to embodiments of the present disclosure, the change in the characteristic value of the driving transistor DRT disposed in the subpixel SP may be compensated for in real time by the driving of the internal compensation method, and the display device may be driven. Meanwhile, in the above-described example, information about the characteristic value of the driving transistor DRT may be applied to the second node N2, which may be the source node of the driving transistor DRT.

Accordingly, in the boosting period of the display period DP, information on the characteristic value of the driving transistor DRT stored in the second node N2 may be transmitted to the first node N1 serving as the gate node. In this case, the first node N1 may form a capacitance by the second node N2 and the storage capacitor Cstg, but may also form a parasitic capacitance with other signal lines in the subpixel SP.

For example, the first node N1 may form a parasitic capacitance with a voltage line, such as the gate line GL or the driving voltage line DVL in the subpixel SP. In addition, a loss may occur in a process in which information on the characteristic value of the driving transistor DRT stored in the second node N2 is transmitted to the first node N1, due to the parasitic capacitance.

With reference to FIG. 3, when the threshold voltage of the driving transistor DRT is Vth because deterioration of the driving transistor DRT does not proceed, the difference Vgs1 between the voltage of the first node N1 and the voltage of the second node N2 during the data writing period of the display period DP may be (Vdata+Vth). When a boosting remain ratio, excluding the loss due to parasitic capacitance in the boosting process, is referred to as "B_Remain," the boosting remain ratio B_Remain may be a value less than 1 (e.g., 0.5, 0.6, etc.). A boosting loss ratio may be a value obtained by subtracting the boosting remain ratio from 1.

The difference between the voltage of the first node N1 and the voltage of the second node N2 during the light emission period of the display period DP may be Vgs1'. Vgs1' may be different from Vgs1, which is a difference between the voltage of the first node N1 and the voltage of the second node N2 in the data writing period. For example, Vgs1' may be smaller than Vgs1. Vgs1' may be a value obtained by subtracting a loss value of AVs from Vgs1. In other words, Vgs1' may be a value obtained by the lost value of AVs configured based on Vgs1 in a boosting process from Vgs1.

Alternatively, in some cases, Vgs1' may be (Vgs1×B_Remain). Vgs1 may be lost to be remained as the boosting remain ratio in the boosting process. Alternatively, in some cases, Vgs1' may be (Vgs1×B_Remain'). B_Remain' may be greater than B_Remain. When a loss occurs on the second node N2 in the boosting process, a loss value of Vgs1 may be smaller than a loss value of the voltage of the second node N2.

When the deterioration of the driving transistor DRT progresses and the change value of the threshold voltage of the driving transistor DRT becomes ΔVth, the difference Vgs2 between the voltage of the first node N1 and the voltage of the second node N2 in the data writing period of the display period DP may be (Vgs1+ΔVth). During the light emission period of the display period DP, Vgs1 may become Vgs1'. ΔVth may become (ΔVth×B_Remain) in the light emission period by a loss in the boosting process. Vgs2' may become {Vgs1'+(ΔVth×B_Remain)}.

As discussed above, when a loss of ΔVth compensated for in the compensation period CP occurs, the position of the operating point of the light-emitting device ED may be changed during the light emission period due to inaccurate compensation of ΔVth. Accordingly, as in the light emission period of the display period DP shown in the example of FIG. 3, there may be a difference ΔD between the voltage of the second node N2 before the deterioration of the driving transistor DRT and the voltage of the second node N2 after the deterioration of the driving transistor DRT. As a result, a non-uniform driving may be generated between the subpixels SP due to this difference.

Embodiments of the present disclosure may provide a method capable of reducing or preventing loss of compensation values during the boosting period, and improving the accuracy of compensation in the process of compensating for changes in the characteristic values of the driving transistors DRT using the internal compensation method.

Figure 4:
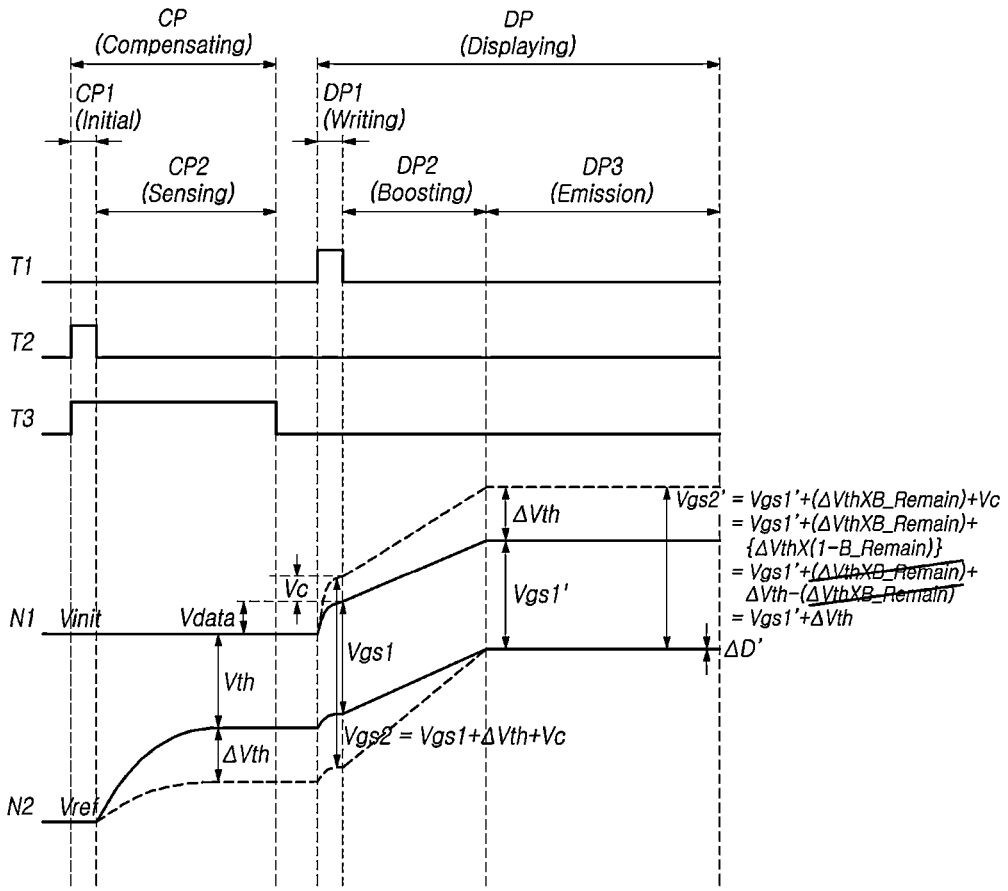
FIG. 4 illustrates another example of a driving method of a subpixel included in a display device according to embodiments of the present disclosure.
Figure 5:
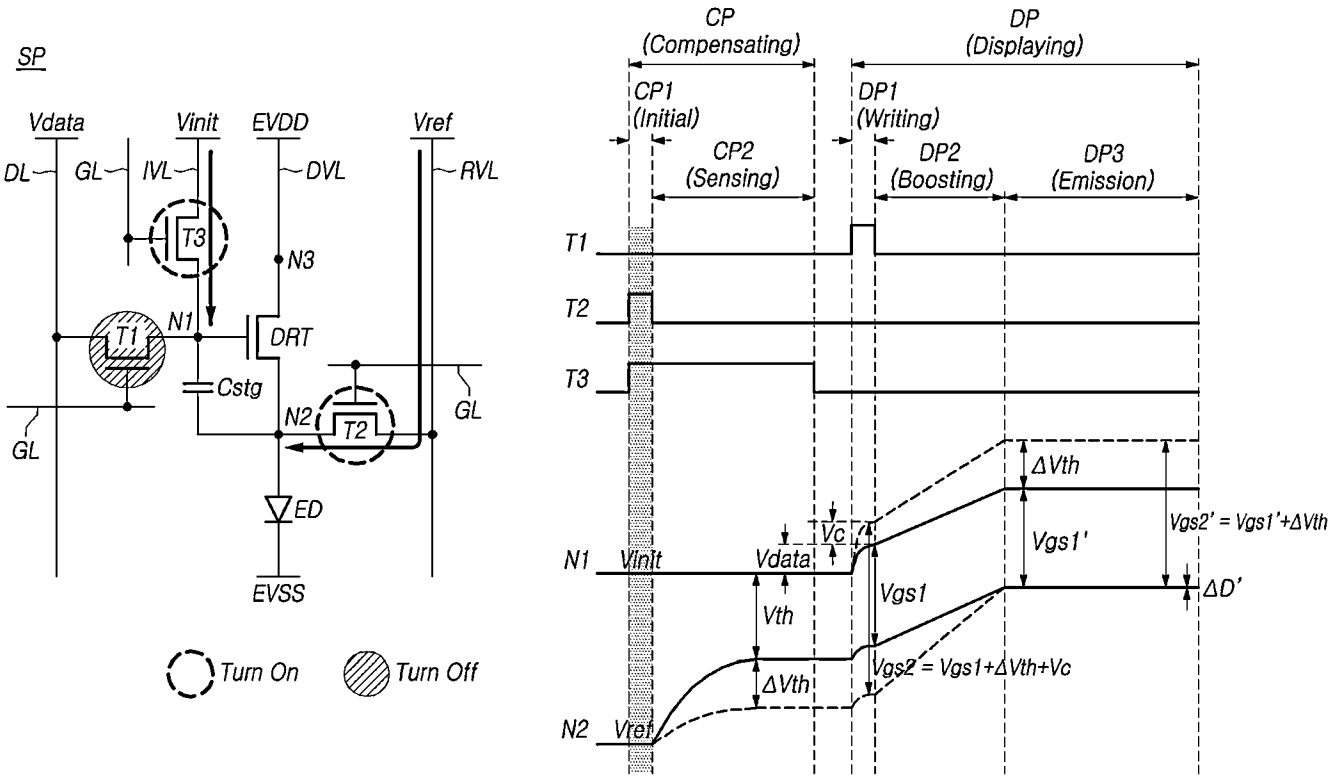
FIGS. 5 to 9 illustrate stages of the driving method of the subpixel shown in FIG. 4.

FIG. 4 illustrates another example of a driving method of a subpixel included in a display device according to embodiments of the present disclosure.

With reference to the example of FIG. 4, one frame period in which the subpixel SP is driven may include a compensation period CP and a display period DP. In an initialization period of the compensation period CP, an initialization voltage Vinit may be applied to a first node N1, and a reference voltage Vref may be applied to a second node N2. In a sensing period of the compensation period CP, the second node N2 may be in a floating state, and the voltage of the second node N2 may increase.

The difference between the voltage of the first node N1 and the voltage of the second node N2 through the compensation period CP may correspond to (Vth+ΔVth), which is the changed threshold voltage of the driving transistor DRT. In addition, in the example shown in FIG. 4 ΔVth is positively shifted, but in some cases, ΔVth may be negatively shifted.

The voltage applied to the first node N1 in a data writing period of the display period DP may be the sum of the data voltage Vdata and the loss compensation voltage Vc. For example, the data voltage Vdata may be a voltage corresponding to the luminance displayed by the light-emitting device ED disposed in the subpixel SP. In addition, the loss compensation voltage Vc may be a voltage for compensating for loss in a boosting process of the change value ΔVth of the threshold voltage of the driving transistor DRT compensated for in the compensation period CP. As an example, the loss compensation voltage Vc may be a value obtained by multiplying the change value ΔVth of the threshold voltage of the driving transistor DRT by a boosting loss ratio.

The boosting loss ratio may be referred as "B_Loss," and the boosting loss ratio B_Loss may be expressed as (1−B_Remain). That is, the sum of the boosting loss ratio and the boosting remain ratio may be 1. Accordingly, the loss compensation voltage Vc may be expressed as (ΔVth*(1−B_Remain)).

The boosting remain ratio may be a ratio of the voltage excluding the voltage lost by the parasitic capacitance in the boosting process. The boosting remain ratio may be, for example, a ratio of a change value of a voltage of the second node N2 in a light emission period of the display period DP, with respect to the change value ΔVs of the voltage of the second node N2, configured based on a difference between a voltage of the first node N1 and a voltage of the second node N2 in a data writing period of the display period DP. Alternatively, in some cases, the boosting remain ratio may be, in a state in which the change value ΔVth of the threshold voltage of the driving transistor DRT is 0, a ratio of a difference between a voltage of the first node N1 and a voltage of the second node N2 in a light emission period of the display period DP, with respect to a difference between a voltage of the first node N1 and a voltage of the second node N2 in the data writing period of the display period DP. Alternatively, the boosting remain ratio may be a ratio of a capacitance by the storage capacitor Cstg to a sum of a parasitic capacitance Cpara formed by the first node N1 and the capacitance by the storage capacitor Cstg (e.g., B_Remain=Cstg/(Cpara+Cstg)).

Because the boosting remain ratio is less than 1, the loss compensation voltage Vc may be smaller than the change value ΔVth of the threshold voltage of the driving transistor DRT. The loss compensation voltage Vc, set in consideration of the boosting remain ratio, may be supplied to the first node N1, in addition to the data voltage Vdata, during the data writing period of the display period DP.

When the data voltage Vdata is applied to the first node N1 of the driving transistor DRT, there may be added (ΔVth×(1−B_Remain)), which is a value at which the change value ΔVth of the threshold voltage of the driving transistor can be lost in the boosting process, so that it may be possible to compensate for the loss of ΔVth in the boosting period and to improve the accuracy of the compensation. For example, as the internal compensation is performed in the compensation period CP before the display period DP, the difference between the voltage of the first node N1 and the voltage of the second node N2 may be a voltage corresponding to (Vth+ΔVth) which is a changed threshold voltage of the driving transistor DRT. A compensation for ΔVth, which is a changed value of the threshold voltage, may be performed.

The data voltage Vdata and the loss compensation voltage Vc may be applied to the first node N1 in the data writing period of the display period DP. The data voltage Vdata may be a voltage corresponding to a luminance that the light-emitting device ED represents. The loss compensation voltage Vc may be a voltage for compensating for ΔVth, compensated for in the compensation period CP, being lost in the boosting process. It may mean that the data voltage Vdata, which is sum of a first voltage corresponding to a luminance the light-emitting device ED represents and a second voltage for compensating a loss of ΔVth, is applied to the first node N1.

When ΔVth is applied to the second node N2 in the compensation period CP, ΔVth may be lost in the boosting process. A loss of ΔVth may be compensated for by the loss compensation voltage Vc, which may be applied to the first node N1 with the data voltage Vdata. When (Vdata+Vc) is applied to the first node N1 in the data writing period of the display period DP, Vgs2, which is a difference between the voltage of the first node N1 and the voltage of the second node N2, may be (Vgs1+ΔVth+Vc).

A loss by a parasitic capacitance formed by the first node N1 may occur in the boosting period of the display period DP. Vgs2 of the data writing period of the display period DP may be changed to Vgs2' in the light emission period of the display period DP. Vgs2' may be expressed as in the following equations.

$$\begin{aligned} Vgs2' &= Vgs1' + (\Delta Vth \times \text{B_Remain}) + Vc \\ &= Vgs1' + (\Delta Vth \times \text{B_Remain}) + \{\Delta Vth\ X\ (1 - \text{B_Remain})\} \\ &= Vgs1' + (\Delta Vth \times \text{B_Remain}) + \Delta Vth - (\Delta Vth \times \text{B_Remain}) \\ &= Vgs1' + \Delta Vth \end{aligned}$$

When the loss compensation voltage Vc is applied to the first node N1 with the data voltage Vdata, the loss compensation voltage Vc may not be lost, unlike the voltage of the second node N2 being lost in the boosting period. The loss compensation voltage Vc may be maintained on the first node N1 in the light emission period after the boosting period of the display period DP. A lost value of ΔVth may be compensated for by the loss compensation voltage Vc.

A changed value ΔVth of the threshold voltage compensated for in the compensation period CP before the display period DP may be maintained in the light emission period of the display period DP. The changed value ΔVth of the threshold voltage, according to the degeneration of the driving transistor DRT, may be compensated for accurately. When the changed value ΔVth of the threshold voltage is compensated for accurately, a luminance that the subpixel SP represents may be controlled accurately. A display quality being lowered may be reduced or prevented.

Alternatively, the loss compensation voltage Vc may be a value obtained by dividing a value obtained by multiplying the change value ΔVth of the threshold voltage of the driving transistor DRT by the boosting loss ratio by the boosting remain ratio. Alternatively, the loss compensation voltage Vc may be a value obtained by dividing a value obtained by multiplying the change value ΔVth of the threshold voltage of the driving transistor DRT by the boosting loss ratio by a value greater than the boosting remain ratio and smaller than 1.

When the loss compensation voltage Vc is applied to the first node N1 in the data writing period of the display period DP, the loss compensation voltage Vc may not be lost when the voltage of the second node N2 increases. However, in some cases, the loss compensation voltage Vc may be lost when a smaller ratio than a ratio that the voltage of the second node N2 is lost. Alternatively, in some cases, the loss compensation voltage Vc may be lost when a same ratio with the ratio that the voltage of the second node N2 is lost.

For example, when the loss compensation voltage Vc is lost when same ratio with the ratio that the voltage of the second node N2 is lost, the loss compensation voltage Vc may be expressed as (ΔVth×B_Loss/B_Remain) or as (ΔVth×(1−B_Remain)/B_Remain).

If the boosting remain ratio is 0.5 or more, ((1−B_Remain)/B_Remain) may be less than 1. Accordingly, the loss compensation voltage Vc may be smaller than the change value ΔVth of the threshold voltage of the driving transistor DRT. In some cases, if the boosting remain ratio is less than 0.5, the loss compensation voltage Vc may be greater than the change value ΔVth of the threshold voltage of the driving transistor DRT.

The loss compensation voltage Vc may be set in consideration of the loss compensation voltage Vc being lost during the boosting process, thereby reducing or preventing the loss of change value ΔVth of the threshold voltage of the driving transistor DRT during the boosting process, and accurately performing the compensation of ΔVth by the internal compensation. For example, when the internal compensation is performed in the compensation period CP before the display period DP, the difference between the voltage of the first node N1 and the voltage of the second node N2 may be a voltage corresponding to the changed threshold voltage (Vth+ΔVth) of the driving transistor DRT.

In a data writing period of the display period DP, a voltage obtained by summing the data voltage Vdata and the loss compensation voltage Vc may be applied to the first node N1. The data voltage Vdata may be a voltage corresponding to the luminance of the light-emitting device ED, and the loss compensation voltage Vc may be a voltage for compensating for a loss of the compensated ΔVth in the boosting process.

It may be considered that the data voltage Vdata, obtained by adding a first voltage corresponding to the luminance of the light-emitting device ED and a second voltage that may be smaller than the change value ΔVth of the threshold voltage of the driving transistor DRT for compensating for the loss of ΔVth (e.g., the loss compensation voltage), may be supplied to the first node N1. In an embodiment, in the light emission period of the display period, a value, obtained by subtracting the change value of the threshold voltage of the driving transistor DRT from a difference between a voltage of the first node N1 and a voltage of the second node N2 of the driving transistor DRT, may be less than the sum of the first voltage and the threshold voltage of the driving transistor DRT.

When (Vdata+Vc) is supplied to the first node N1 in the data writing period of the display period DP, the difference Vgs2 between the voltage of the first node N1 and the voltage of the second node N2 may be (Vgs1+ΔVth+Vc). When loss due to the parasitic capacitance formed by the first node N1 occurs during the boosting period of the display period DP, the difference Vgs2' between the voltage of the first node N1 and the voltage of the second node N2 in the light emission period of the display period DP may be (Vgs2×B_Remain). Further, Vgs2' may be expressed as in the following equations.

$$\begin{aligned} Vgs2' &= Vgs2 * \text{B_Remain} \\ &= (Vgs1 + \Delta Vth + Vc) * \text{B_Remain} \\ &= Vgs1 * \text{B_Remain} + \Delta Vth * \text{B_Remain} + Vc * \text{B_Remain} \\ &= Vgs1 * \text{B_Remain} + \Delta Vth * \text{B_Remain} + (\Delta Vth * \\ &\quad (1 - \text{B_Remain})/\text{B_Remain}) * \text{B_Remain} \\ &= Vgs1 * \text{B_Remain} + \Delta Vth * \text{B_Remain} + \Delta Vth - \Delta Vth * \\ &\quad \text{B_Remain} \\ &= Vgs1 * \text{B_Remain} + \Delta Vth \end{aligned}$$

Accordingly, the difference Vgs2' between the voltage of the first node N1 and the voltage of the second node N2 in the light emission period of the display period DP may be a value obtained by adding ΔVth to (Vgs1×B_Remain), which is Vgs2 before deterioration of the driving transistor DRT. Thus, accurate compensation of the change value ΔVth of the threshold voltage of the driving transistor DRT can be performed. In addition, because accurate compensation for the change value ΔVth of the threshold voltage of the driving transistor DRT may be performed, the operating point of the light-emitting device ED may be constantly maintained.

In the light emission period of the display period DP, the voltage of the second node N2, before the deterioration of the driving transistor DRT, and the voltage of the second node N2, after the deterioration of the driving transistor DRT, may be maintained to be the same (e.g., ΔD'=0). Accordingly, it may be possible to reduce or prevent non-uniform driving due to a deviation between subpixels SP having different degrees of deterioration of the driving transistor DRT.

FIGS. 5 to 9 illustrate stages of the driving method of the subpixel shown in FIG. 4.

FIGS. 5 to 9 illustrate examples of stages of a driving method of the subpixel SP when the loss compensation voltage Vc is {ΔVth×(1−B_Remain)}. With reference to the example of FIG. 5, there may be a compensation period CP for internal compensation before a display period DP. In an initialization period of the compensation period CP, a first transistor T1 may be turned off, a second transistor T2 may be turned on, and a third transistor T3 may be turned on. When the third transistor T3 is turned on, an initialization voltage Vinit may be applied to a first node N1. When the second transistor T2 is turned on, a reference voltage Vref may be applied to a second node N2.

Figure 6:
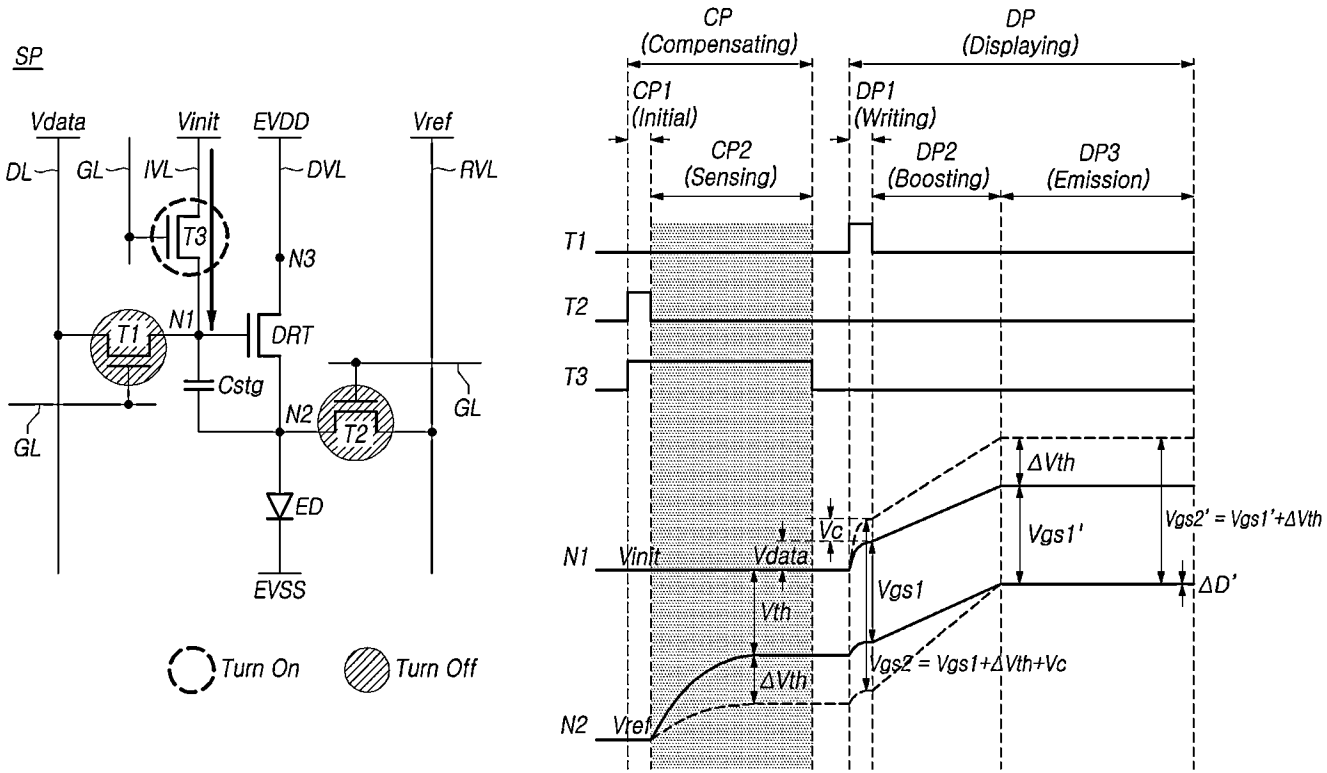

With reference to the example of FIG. 6, the second transistor T2 may be turned off in a sensing period of the compensation period CP. In the sensing period of the compensation period CP, the third transistor T3 may maintain a turn-on state. When the second node N2 is in a floating state while the initialization voltage Vinit is applied to the first node N1, the voltage of the second node N2 may increase. If the voltage of the second node N2 reaches a saturation state, the difference between the voltage of the first node N1 and the voltage of the second node N2 may correspond to the threshold voltage Vth of the driving transistor DRT, or may correspond to the changed threshold voltage (Vth+ΔVth) of the driving transistor DRT. Accordingly, in the compensation period, a change in the threshold voltage of the driving transistor DRT may be compensated for by the internal compensation method.

Figure 7:
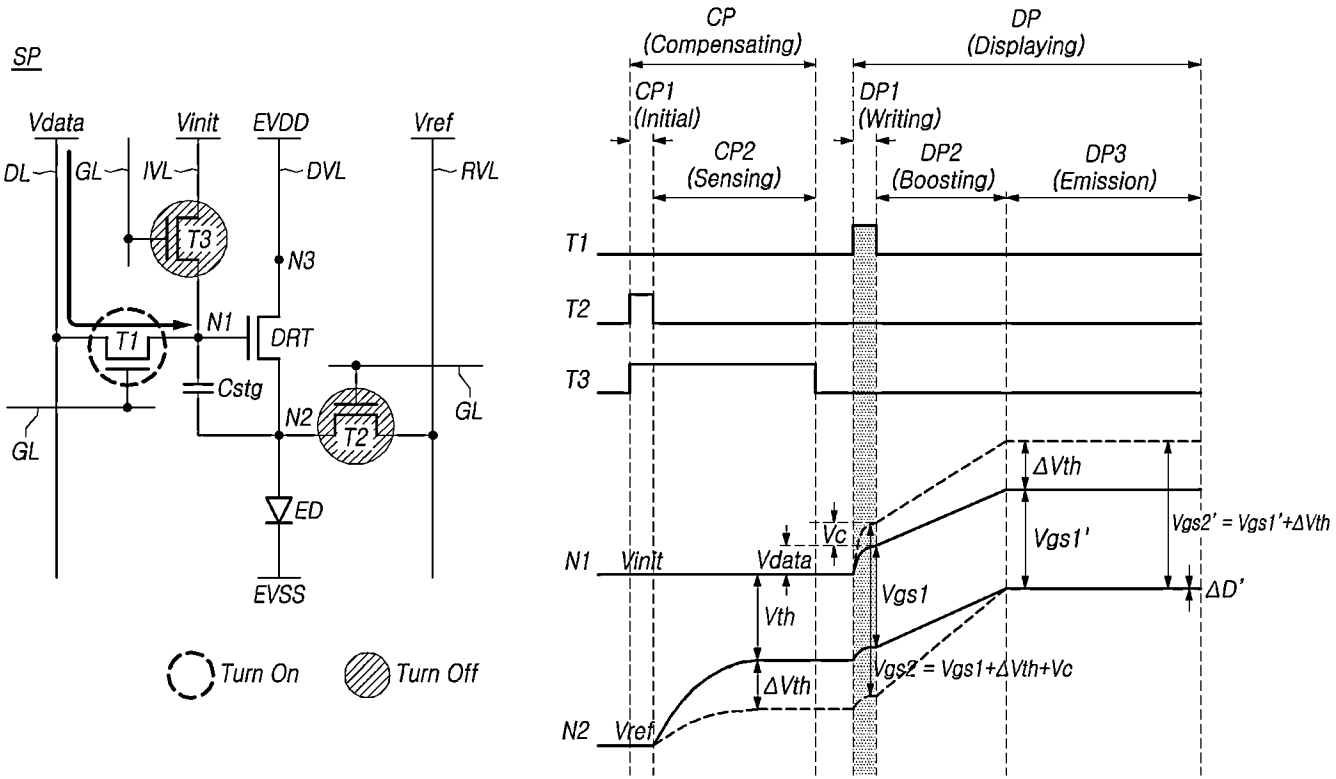

With reference to the example of FIG. 7, in a data writing period of the display period DP, the first transistor T1 may be turned on. The second transistor T2 and the third transistor T3 may maintain a turn-off state during the display period DP. When the first transistor T1 is turned on, a voltage supplied through the data line DL may be applied to the first node N1.

The voltage supplied through the data line DL may be a voltage in which a loss compensation voltage Vc, for compensating for a loss of a change value of the threshold voltage of the driving transistor DRT, is added to the data voltage Vdata corresponding to the image data. The data voltage output from the data driving circuit 130 to the data line DL may be considered as a voltage obtained by adding a first voltage corresponding to image data and a second voltage for loss compensation.

When (Vdata+Vc) is applied to the first node N1 in a state in which the difference between the voltage of the first node N1 and the voltage of the second node N2 is (Vth+ΔVth), the difference between the voltage of the first node N1 and the voltage of the second node N2 may be (Vth+ΔVth+Vdata+Vc). For example, when (Vdata+Vth) is equal to Vgs1, the difference between the voltage of the first node N1 and the voltage of the second node N2 may be (Vgs1+ΔVth+Vc). In the data writing period of the display period DP, the difference Vgs2 between the voltage of the first node N1 and the voltage of the second node N2 may be a voltage obtained by adding Vgs1 before deterioration of the driving transistor DRT to the change value ΔVth of the threshold voltage due to deterioration of the driving transistor DRT and Vc for compensating for a loss of ΔVth during the boosting process.

Figure 8:
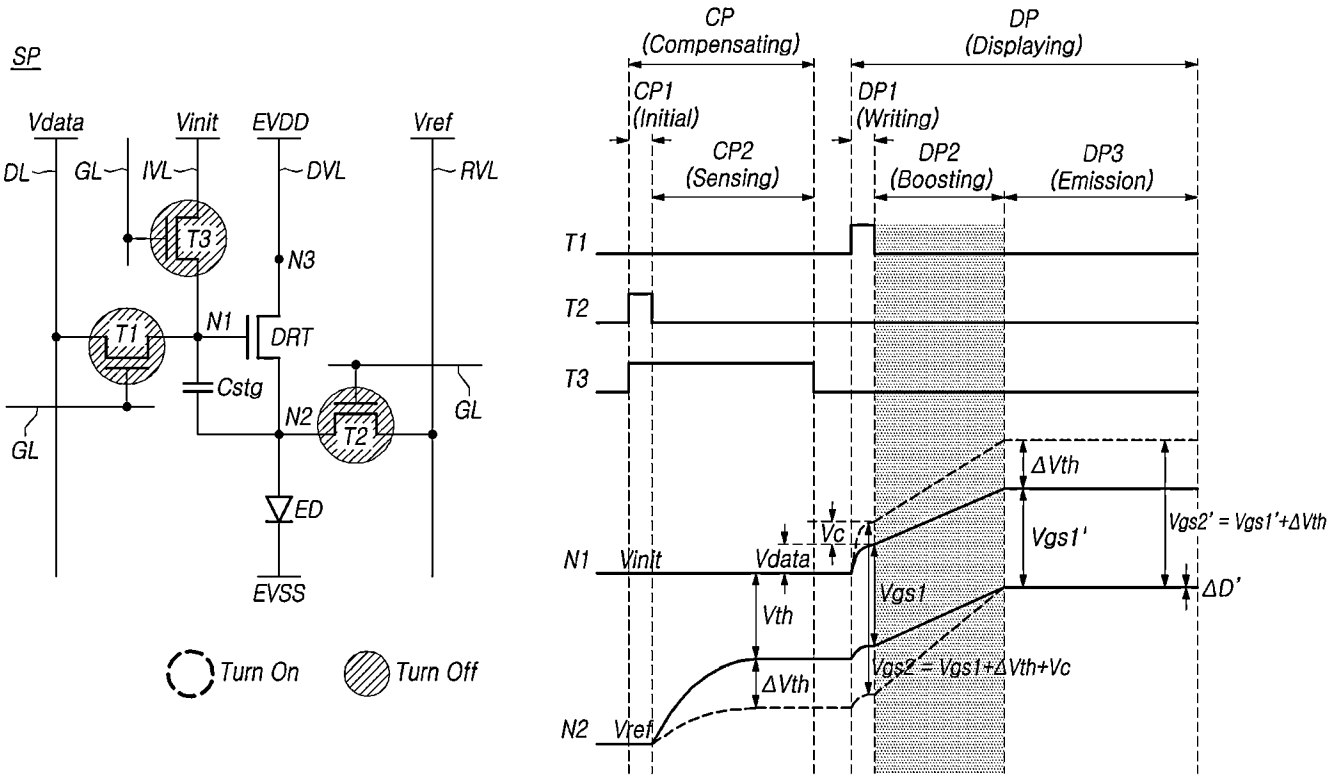

With reference to the example of FIG. 8, in a boosting period of the display period DP, the first transistor T1 may be turned off. When the first transistor T1 is turned off, the first node N1 may be in a floating state. When the first node N1 and the second node N2 are in a floating state, the voltage of the first node N1 and the voltage of the second node N2 may increase. When the voltage of the second node N2 coincides with the operating point of the light-emitting device ED, the increase of the voltage of the first node N1 and the increase of the voltage of the second node N2 may be stopped.

Figure 9:
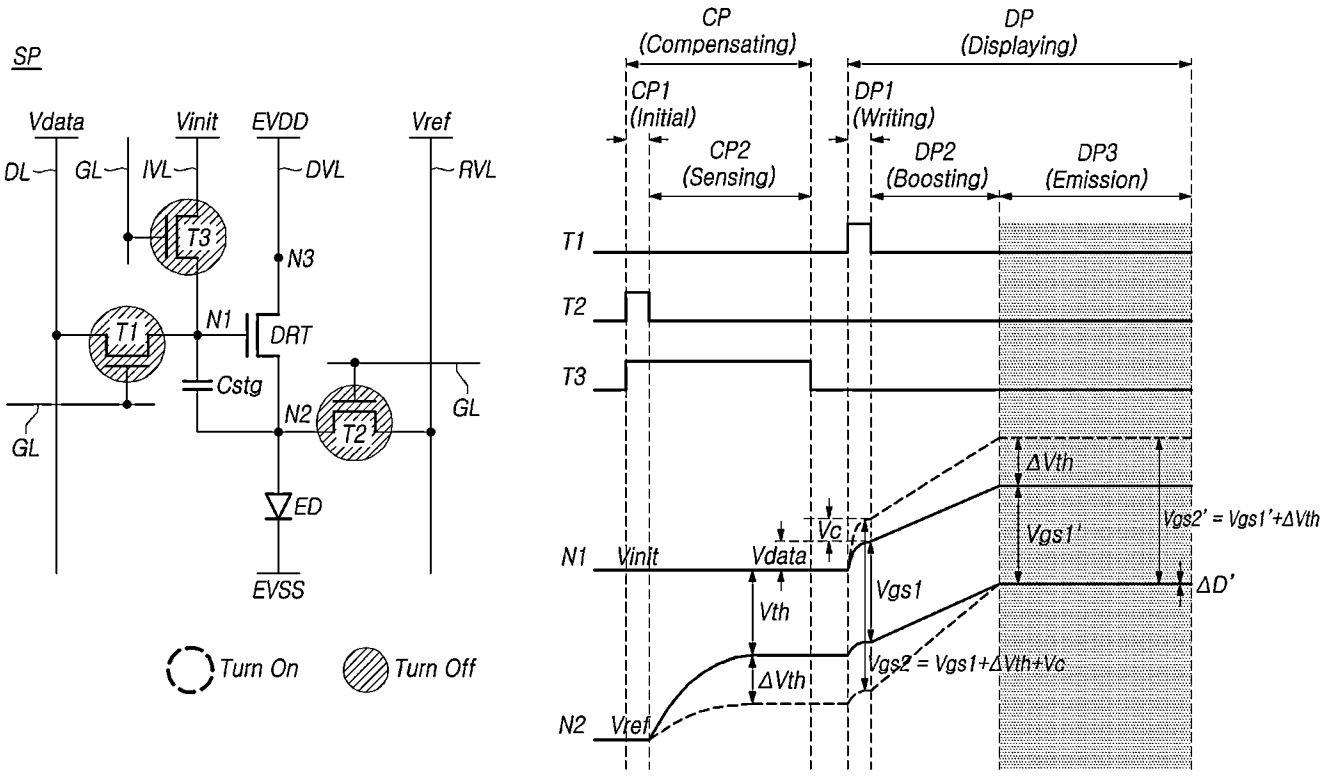

With reference to the example of FIG. 9, a driving current corresponding to a difference between the voltage of the first node N1 and the voltage of the second node N2 may be supplied to the light-emitting device ED in a light emission period of the display period DP. The light-emitting device ED may emit light according to the driving current supplied by the driving transistor DRT, and may display luminance corresponding to image data.

The difference Vgs2' between the voltage of the first node N1 and the voltage of the second node N2 in the light emission period of the display period DP may be {Vgs1'+(ΔVth×B_Remain)+Vc}. As described above, Vc may be {ΔVth×(1−B_Remain)}, which corresponds to a value obtained by adding ΔVth to Vgs1' before deterioration of the driving transistor DRT. That is, in the boosting period, the loss of Vgs1 may be maintained the same as before the deterioration of the driving transistor DRT, so that the loss of ΔVth can be compensated for to increase the accuracy of compensation of ΔVth by internal compensation.

Therefore, according to embodiments of the present disclosure, the compensation for the deterioration of the driving transistor DRT disposed in the subpixel through internal compensation may be performed in real time. In addition, by additionally supplying a loss compensation voltage Vc for compensating for the loss of the compensation value during the boosting period to the subpixel SP, it may be possible to accurately compensate for the deterioration of the driving transistor DRT.

The loss compensation value Vc, such as discussed above, may be applied to the first node N1 so that a loss by a parasitic capacitance does not occur in the boosting process. The loss compensation value Vc may be a voltage corresponding to a loss value of ΔVth in the boosting process.

Furthermore, in some cases, considering to a case that a loss of at least a part of the loss compensation voltage Vc is occurred, the loss compensation value Vc may be calculated by dividing the voltage corresponding to the loss value of ΔVth by a value which is greater or equal to the boosting remain ratio and smaller than 1. In addition, a change value ΔVth of the threshold voltage of the driving transistor DRT should be obtained to calculate the loss compensation voltage Vc.

Figure 10:
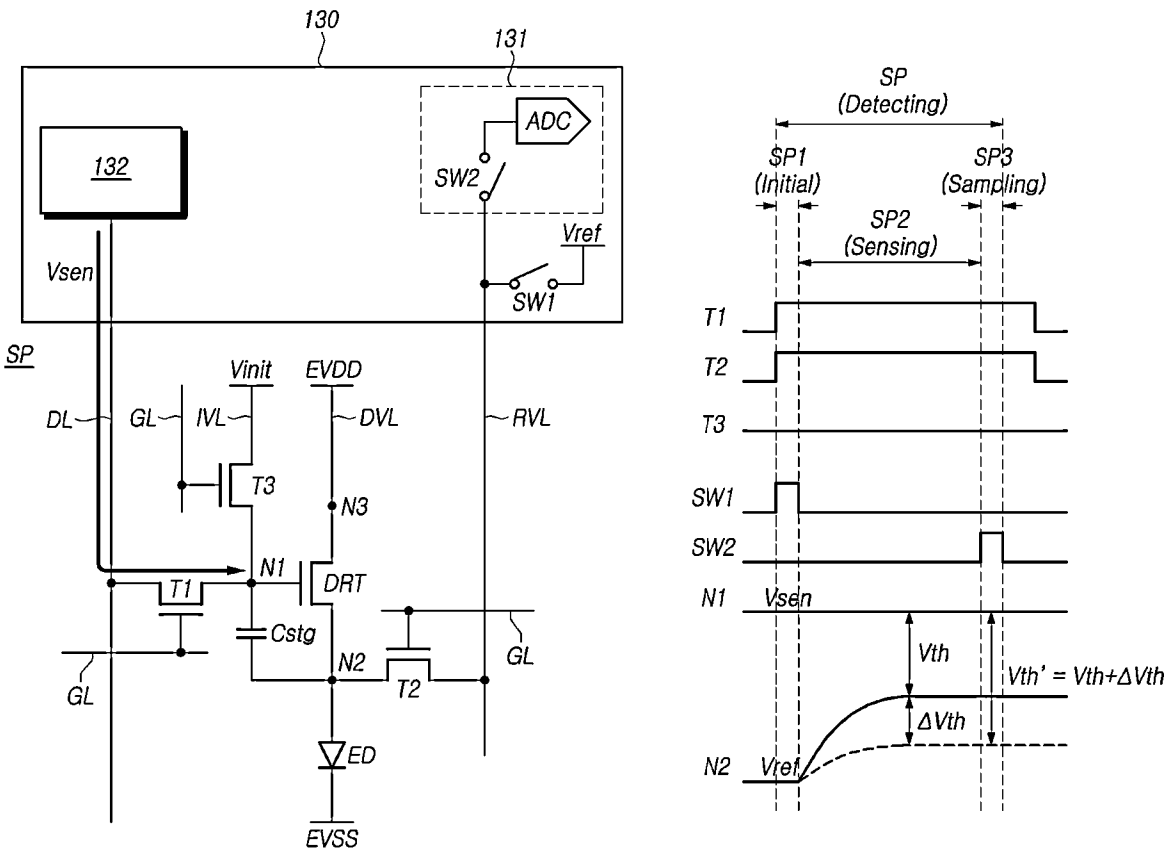
FIGS. 10 and 11 illustrate examples of a method of obtaining a change value of a threshold voltage of a driving transistor included in a subpixel when driving a subpixel according to the driving method of the subpixel shown in FIG. 4.
Figure 11:
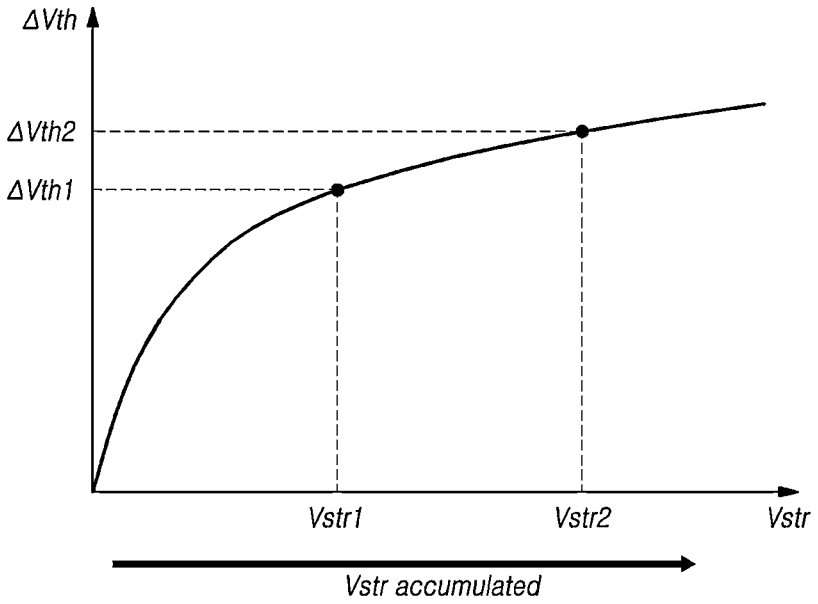

FIGS. 10 and 11 illustrate examples of a method of obtaining a change value of a threshold voltage of a driving transistor included in a subpixel when driving a subpixel according to the driving method of the subpixel shown in FIG. 4.

With reference to the example of FIG. 10, a display device, e.g., the display device 100 of the FIG. 1 example, may detect a change value ΔVth of a threshold voltage of the driving transistor DRT by, for example, a method of detecting a change value of a characteristic value of the driving transistor DRT according to an external compensation method. The display device 100 may detect the change value ΔVth of the threshold voltage of the driving transistor DRT during the detection period SP.

As an example, the change value ΔVth of the threshold voltage of the driving transistor DRT may be detected by a data driving circuit 130 included in the display device 100. Alternatively, in some cases, the change value ΔVth of the threshold voltage of the driving transistor DRT may be detected by a configuration separately disposed from the data driving circuit 130.

The detection period SP may be a period other than the frame period during which display driving is performed. For example, the detection period SP may be a designated period after driving of the display device 100 is started. Alternatively, the detection period SP may be a predetermined period after the driving of the display device 100 is terminated. Alternatively, in some cases, the detection period SP may be at least a partial period of a blank period among the frame periods. The detection period SP may be referred to as an "external" sensing period. The detection period SP (external sensing period) may be a period other than the frame period before or after driving the display. Or, the detection period SP (external sensing period) may be a period included in the frame period.

The data driving circuit 130 may include a sensing unit 131 and a data voltage output unit 132. The detection period SP may include a first detection period SP1 corresponding to an initialization period, a second detection period SP2 corresponding to a sensing period, and a third detection period SP3 corresponding to a sampling period.

In the initialization period of the detection period SP, a first transistor T1 may be turned on, and a second transistor T2 may be turned on. In the detection period SP, a third transistor T3 may maintain a turn-off state. In the initialization period of the detection period SP, a first switch SW1 electrically connected to a reference voltage line RVL may be turned on, and a second switch SW2 may be turned off.

When the first transistor T1 is turned on, a sensing data voltage Vsen output by the data voltage output unit 132 may be applied to the first node N1. When the second transistor T2 and the first switch SW1 are turned on, a reference voltage Vref may be applied to the second node N2. The first switch SW1 may be turned off during the sensing period of the detection period SP.

Accordingly, a voltage of the second node N2 may increase during the sensing period of the detection period SP. In addition, when a predetermined period elapses, the voltage of the second node N2 may reach a saturation state. If the voltage of the second node N2 reaches the saturation state, the difference between the voltage of the first node N1 and the voltage of the second node N2 may correspond to a changed threshold voltage Vth' (=Vth+ΔVth) of the driving transistor DRT.

In the sampling period of the detection period SP, the second switch SW2, electrically connected between the reference voltage line RVL and an analog-to-digital converter ADC, may be turned on. Accordingly, the voltage of the second node N2 may be sampled.

Through the above-described process, the change value ΔVth of the threshold voltage of the driving transistor DRT may be detected. A loss compensation voltage Vc may be calculated using the detected ΔVth.

When outputting the data voltage Vdata in the display period DP, the data voltage output unit 132 of the data driving circuit 130 may output a voltage to which the loss compensation voltage Vc is reflected, thereby accurately compensating the ΔVth by the internal compensation. Alternatively, the loss compensation voltage Vc may be calculated using the change value ΔVth of the threshold voltage set according to the accumulated stress of the driving transistor DRT, without using the detection method according to the external compensation method.

With reference to the example of FIG. 11, the display device 100 may include a look-up table, in which a stress value Vstr of the driving transistor DRT and a change value ΔVth corresponding to the stress value Vstr may be set. Such a look-up table, for example, may be stored in a memory located inside or outside the controller 140.

The stress value Vstr of the driving transistor DRT may be, for example, a value calculated by accumulating the data voltage Vdata supplied to a gate node of the driving transistor DRT as the display device 100 is driven. As the driving time of the driving transistor DRT increases, the stress value Vstr may increase. The change value ΔVth of the threshold voltage of the driving transistor DRT corresponding to the increased stress value Vstr may be identified through the look-up table.

As an example, a change value corresponding to a first stress value Vstr1 may be ΔVth1, and a change value corresponding to a second stress value Vstr2 may be ΔVth2. Because the change value ΔVth of the threshold voltage of the driving transistor DRT can be identified through the look-up table, the loss compensation voltage Vc can be calculated using the identified ΔVth. The ΔVth predicted according to the driving of the driving transistor DRT may be used without performing a separate driving for detecting the change value ΔVth of the threshold voltage of the driving transistor DRT, thereby easily calculating the loss compensation voltage Vc for improving the accuracy of internal compensation.

According to the above-described embodiments of the present disclosure, the change in the characteristic value of the driving transistor DRT disposed in the subpixel SP may be compensated for by using the internal compensation method, so that the deterioration of the driving transistor DRT may be easily compensated for in the driving process of the subpixel SP. In addition, the loss compensation voltage Vc calculated based on a change value of a characteristic value of the driving transistor DRT may be added to the voltage supplied to the subpixel SP. Accordingly, it may be possible to reduce or prevent the change value ΔVth of the threshold voltage of the driving transistor DRT reflected by the internal compensation from being lost in a boosting period and to improve the accuracy of the internal compensation.

In one aspect, embodiments of the present disclosure may provide a display device including a display panel on which a plurality of subpixels may be disposed, and a data driving circuit supplying a data voltage to the plurality of subpixels. Each of the plurality of subpixels may include a light-emitting device, a driving transistor for driving the light-emitting device, and a storage capacitor electrically connected between a first node and a second node of the driving transistor. The data driving circuit may detect, in an external sensing period, a change value of a threshold voltage of the driving transistor included in at least one of the plurality of subpixels. The data driving circuit may supply, in a display period, the data voltage obtained by adding a first voltage corresponding to a luminance of the light-emitting device and a second voltage smaller than the change value of the threshold voltage of the driving transistor to at least one subpixel of the plurality of subpixels.

The second voltage may be a value obtained by multiplying the change value of the threshold voltage of the driving transistor by a boosting loss ratio. The boosting loss ratio may be a value obtained by subtracting a boosting remain ratio from 1.

The boosting remain ratio may be a ratio of a change value of a voltage of the second node of the driving transistor in a light emission period of the display period with respect to a change value of a voltage of the second node configured based on a difference between a voltage of the first node and a voltage of the second node of the driving transistor in a data writing period of the display period. The boosting remain ratio may be a ratio of a capacitance by the storage capacitor to a sum of a parasitic capacitance formed by the first node of the driving transistor and the capacitance by the storage capacitor.

In another aspect, embodiments of the present disclosure may provide a display device including a display panel on which a plurality of subpixels including a light-emitting device and a driving transistor for driving the light-emitting device may be disposed, and a data driving circuit for supplying a data voltage to the plurality of subpixels. The data driving circuit may supply, in a display period, the data voltage obtained by adding a first voltage corresponding to a luminance of the light-emitting device and a second voltage smaller than a change value of a threshold voltage of the driving transistor to at least one subpixel of the plurality of subpixels.

In another aspect, embodiments of the present disclosure may provide a data driving circuit including a sensing unit configured to detect a change value of a threshold voltage of a driving transistor included in at least one of a plurality of subpixels in an external sensing period, and a data voltage output unit configured to supply, in a display period, a data voltage obtained by adding a first voltage corresponding to a luminance of the subpixel and a second voltage smaller than the change value of a threshold voltage of the driving transistor to at least one subpixel of the plurality of subpixels.

According to embodiments of the present disclosure, a voltage difference between a gate node and a source node of the driving transistor corresponds to the changed threshold voltage of the driving transistor, so that it may be possible to compensate for a change in the characteristic value of a driving transistor during the driving process of the subpixel.

According to embodiments of the present disclosure, a data voltage may be supplied, including a voltage capable of compensating for a loss of a change value of a threshold voltage of the driving transistor in a data writing period of the display period, so that it may be possible to reduce or prevent loss of the change value of the threshold voltage of the driving transistor during a boosting period.

According to embodiments of the present disclosure, in compensating for the change value of the characteristic value of the driving transistor disposed in the subpixel by an internal compensation method, by supplying a voltage including a loss compensation voltage calculated based on the change value of the characteristic value of the driving transistor to the subpixel, it may be possible to reduce or prevent the compensation value reflected by the internal compensation from being lost in a boosting period after an internal compensation period and to improve the accuracy of the internal compensation.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display device, comprising:

a display panel comprising a plurality of subpixels; and a data driving circuit configured to supply a data voltage to the plurality of subpixels, wherein each of the plurality of subpixels comprises:

a light-emitting device, a driving transistor configured to drive the light-emitting device, and a storage capacitor electrically connected between a first node and a second node of the driving transistor, wherein the data driving circuit is further configured to:

detect, in an external sensing period, a change value of a threshold voltage of the driving transistor comprised in at least one of the plurality of subpixels, and supply, in a display period, to at least one subpixel of the plurality of subpixels:

the data voltage, obtained by adding a first voltage corresponding to a luminance of the light-emitting device, and a second voltage smaller than the change value of the threshold voltage of the driving transistor, wherein the second voltage is a value obtained by multiplying the change value of the threshold voltage of the driving transistor by a boosting loss ratio.

2. The display device of claim 1, wherein the boosting loss ratio is a value obtained by subtracting a boosting remain ratio from 1.

3. The display device of claim 2, wherein the boosting remain ratio is a ratio of a change value of a voltage of the second node of the driving transistor in a light emission period of the display period with respect to a change value of a voltage of the second node configured based on a difference between a voltage of the first node and a voltage of the second node of the driving transistor in a data writing period of the display period.

4. The display device of claim 2, wherein the boosting remain ratio is a ratio of a capacitance by the storage capacitor to a sum of a parasitic capacitance formed by the first node of the driving transistor and the capacitance by the storage capacitor.

5. The display device of claim 1, wherein a difference between a voltage of the first node and a voltage of the second node of the driving transistor before the display period corresponds to a changed threshold voltage of the driving transistor.

6. The display device of claim 1, wherein:

a change value of the threshold voltage of the driving transistor comprised in a first subpixel among the plurality of subpixels is 0;

a change value of the threshold voltage of the driving transistor comprised in a second subpixel is not zero; and in a light emission period of the display period, a voltage of the second node of the driving transistor comprised in the first subpixel is the same as a voltage of the second node of the driving transistor comprised in the second subpixel.

7. The display device of claim 1, wherein, in a light emission period of the display period, a value obtained by subtracting the change value of the threshold voltage of the driving transistor from a difference between a voltage of the first node and a voltage of the second node of the driving transistor is less than the sum of the first voltage and the threshold voltage of the driving transistor.

8. The display device of claim 1, wherein each of the plurality of subpixels further comprises:

a first transistor electrically connected between the first node of the driving transistor and a data line;

a second transistor electrically connected between the second node of the driving transistor and a reference voltage line; and a third transistor electrically connected between the first node of the driving transistor and an initialization voltage line.

9. The display device of claim 8, wherein, in a compensation period prior to the display period, the first transistor is configured to be in a turn-off state.

10. The display device of claim 8, wherein:

the second transistor and the third transistor are configured to be turned on in an initialization period of a compensation period prior to the display period; and in an internal sensing period of the compensation period: the second transistor is configured to be turned off; and the third transistor configured to maintain a turn-on state.

11. The display device of claim 10, wherein, in the initialization period, a difference between an initialization voltage supplied through the initialization voltage line and a reference voltage supplied through the reference voltage line is greater than the threshold voltage of the driving transistor.

12. The display device of claim 8, wherein:

the first transistor is configured to be turned on in a data writing period of the display period; and the first transistor is configured to be turned off in a boosting period and a light emission period of the display period.

13. The display device of claim 8, wherein the second transistor and the third transistor are configured to be in a turn-off state in the display period.

14. A data driving circuit, comprising:

a sensing unit configured to detect a change value of a threshold voltage of a driving transistor, in at least one of a plurality of subpixels, in an external sensing period; and a data voltage output unit configured to supply, in a display period, to at least one subpixel of the plurality of subpixels:

a data voltage obtained by adding a first voltage corresponding to a luminance of the subpixel; and a second voltage smaller than the change value of the threshold voltage of the driving transistor, wherein the second voltage is a value obtained by multiplying the change value of the threshold voltage of the driving transistor by a boosting loss ratio.

* * * * *